US012006113B2

(12) United States Patent
Robinson et al.

(10) Patent No.: US 12,006,113 B2
(45) Date of Patent: Jun. 11, 2024

(54) CANNABINOID AND ALKALOID BEVERAGE CONTAINERS, AND ASSOCIATED DEVICES, SYSTEMS, AND METHODS

(71) Applicant: Green Sky Creations LLC, Seattle, WA (US)

(72) Inventors: Simon Robinson, Seattle, WA (US); Brad Douglass, Seattle, WA (US)

(73) Assignee: Green Sky Creations LLC, Seattle, WA (US)

( * ) Notice: Subject to any disclaimer, the term of this patent is extended or adjusted under 35 U.S.C. 154(b) by 0 days.

(21) Appl. No.: 18/065,710

(22) Filed: Dec. 14, 2022

(65) Prior Publication Data

US 2023/0286710 A1 Sep. 14, 2023

Related U.S. Application Data

(62) Division of application No. 17/689,265, filed on Mar. 8, 2022, now Pat. No. 11,548,703.

(51) Int. Cl.
*B65D 51/28* (2006.01)

(52) U.S. Cl.
CPC ..... *B65D 51/2878* (2013.01)

(58) Field of Classification Search
CPC ..... B65D 51/2878; B65D 51/2807; B65D 51/28; B65D 51/26; B65D 51/249; B65D 51/248; B65D 51/247; B65D 51/246; B65D 51/245; B65D 51/244; B65D 51/243; B65D 51/242; B65D 51/241; B65D 51/24; A47J 31/401
See application file for complete search history.

(56) References Cited

U.S. PATENT DOCUMENTS

2004/0018278 A1* 1/2004 Popplewell ..... B65D 65/38 426/132
2004/0040961 A1* 3/2004 Vilalta ..... B65D 81/2038 220/203.23
2004/0099665 A1* 5/2004 McEldowney .... B65D 17/4011 220/276

(Continued)

OTHER PUBLICATIONS

Sprudge Staff; How to make magically medicated marijuana mochas; Jan. 12, 2015; Drinks Lifestyle; pp. 1-43.*

*Primary Examiner* — Kareen K Thomas
(74) *Attorney, Agent, or Firm* — Perkins Coie LLP

(57) ABSTRACT

The present disclosure is generally related to beverage containers, including cannabinoid and/or alkaloid-infused beverage containers, and associated devices, systems, and methods. In at least some embodiments, a beverage container can include one or more container walls forming the sides and/or bottom of the container, a conditioning component configured to releasably contain an active ingredient and to release at least a portion of the active ingredient into the container, and a lid which may be sealably attached to the container wall to create a sealed container. When a liquid is inserted into the beverage container and the lid is sealed to the container wall, the active ingredient can be held separate from the liquid by the conditioning component unless or until the conditioning component is activated/actuated to cause the active ingredient to mix with the liquid and create a beverage infused with the active ingredient.

28 Claims, 6 Drawing Sheets

(56) References Cited

U.S. PATENT DOCUMENTS

| | | | | |
|---|---|---|---|---|
| 2010/0133275 | A1* | 6/2010 | Phillips | B65D 7/40 220/270 |
| 2014/0070432 | A1* | 3/2014 | Tatera | B01F 23/23611 261/34.1 |
| 2016/0000246 | A1* | 1/2016 | Vanderstraeten | B65D 81/2053 220/714 |
| 2018/0362210 | A1* | 12/2018 | Vanderstraeten | B65D 17/4014 |

* cited by examiner

350

| | Application Type | | | |
|---|---|---|---|---|
| 352 | Discrete Coating | Impregnated Liner | Impregnation and Discrete Coating | Widget |
| Physical Agitation | 30-60 seconds | Not Needed | 15-30 seconds | 15-30 seconds |
| Temperature | >40 C | >90 C | >60 C | N/A |
| pH | <6 | <5.5 | <6 | N/A |
| Passive Diffusion | No | Yes | Yes | N/A |
| Magnetic Force | 1 - 2 Teslas | 2-4 teslas | 1.5 - 3 teslas | 1.5 - 3 teslas |
| Electromagnetic Signal | 100 - 400 nm | 1 - 10 cm | 100 - 400 nm and 1 - 10 cm | N/A |
| Enzyme | Amylase 24,000 du | Protease 60,000 hut | Lactase 1,600 alu | N/A |

354

FIG. 3

CANNABINOID AND ALKALOID BEVERAGE CONTAINERS, AND ASSOCIATED DEVICES, SYSTEMS, AND METHODS

CROSS-REFERENCE TO RELATED APPLICATION(S)

This application is a divisional of U.S. patent application Ser. No. 17/689,265, filed Mar. 8, 2022, which is incorporated herein by reference in its entirety.

TECHNICAL FIELD

The present disclosure is generally related to beverage containers, including cannabinoid and/or alkaloid-infused beverage containers, and associated devices, systems, and methods.

BACKGROUND

The distribution and sale of beverages infused with an active ingredient (e.g., one or more cannabinoids and/or alkaloids) has been challenged by a degradation or loss of the active ingredient from the associated beverage prior to consumption, often resulting in underwhelming effects from the beverage and adversely affecting the enjoyment of the consumer. For example, the concentration/dose of infused active ingredient(s) in a beverage can decrease over time, such as from a first concentration provided during manufacturing to a second, reduced concentration at some time later when the beverage is consumed by a consumer. Because the time between manufacturing and consumption can vary greatly, it is difficult to achieve a generally consistent desired concentration of active ingredient(s) within the beverage at the time of consumption. One existing solution is to increase the concentration of active ingredient(s) added to the beverage in order to counteract the subsequent loss of active ingredient(s) over time. However, even after increasing the concentration, the range of active ingredient concentrations at the time of consumption can still vary greatly depending on how much time has passed since manufacturing. Furthermore, if the beverage is consumed shortly after manufacturing such that the concentration of active ingredient is at or near the original, increased concentration, the user may consumer a greater amount of active ingredient than expected. This can lead to improper dosing of the active ingredient, can result in an undesirable experience by the consumer or patient, and may additionally increase the production cost by requiring far more active ingredients (e.g., overages) to ensure that the consumer experiences the desired effect.

Furthermore, the lipophilic nature of cannabinoids and many alkaloids can allow them to migrate into a beverage container's liner and either get stuck there or displace potentially harmful molecules that are byproducts of liner fabrication, such as metal ions in the liner. Metal ions are potentially deleterious themselves and also can catalyze degradative chemistry of active beverage constituents and/or can impart off-flavors to the beverage. Additionally, some liner materials can act as endocrine disruptors and affect the consumer at relatively low concentrations.

In addition, the process of manufacturing beverages to contain cannabinoids or lipophilic alkaloids is akin to mixing oil with water, and thus can present significant stability challenges associated with maintaining the cannabinoids and/or alkaloids in an emulsified state within a liquid. As such, a dosing method is needed to minimize the amount of active ingredient(s) added to an aqueous-based beverage and to simplify the active beverage manufacturing process while ensuring that the concentration of the active ingredient remains within a desired range through the point of consumption.

BRIEF DESCRIPTION OF THE DRAWINGS

Many aspects of the present technology can be better understood with reference to the following drawings. The components in the drawings are not necessarily drawn to scale. Instead, emphasis is placed on illustrating clearly the principles of the present technology. Furthermore, components can be shown as transparent in certain views for clarity of illustration only and not to indicate that the component is necessarily transparent. Components may also be shown schematically.

FIG. 3 is a table including representative parameters in accordance with embodiments of the present technology.

DETAILED DESCRIPTION

Figure 1A:
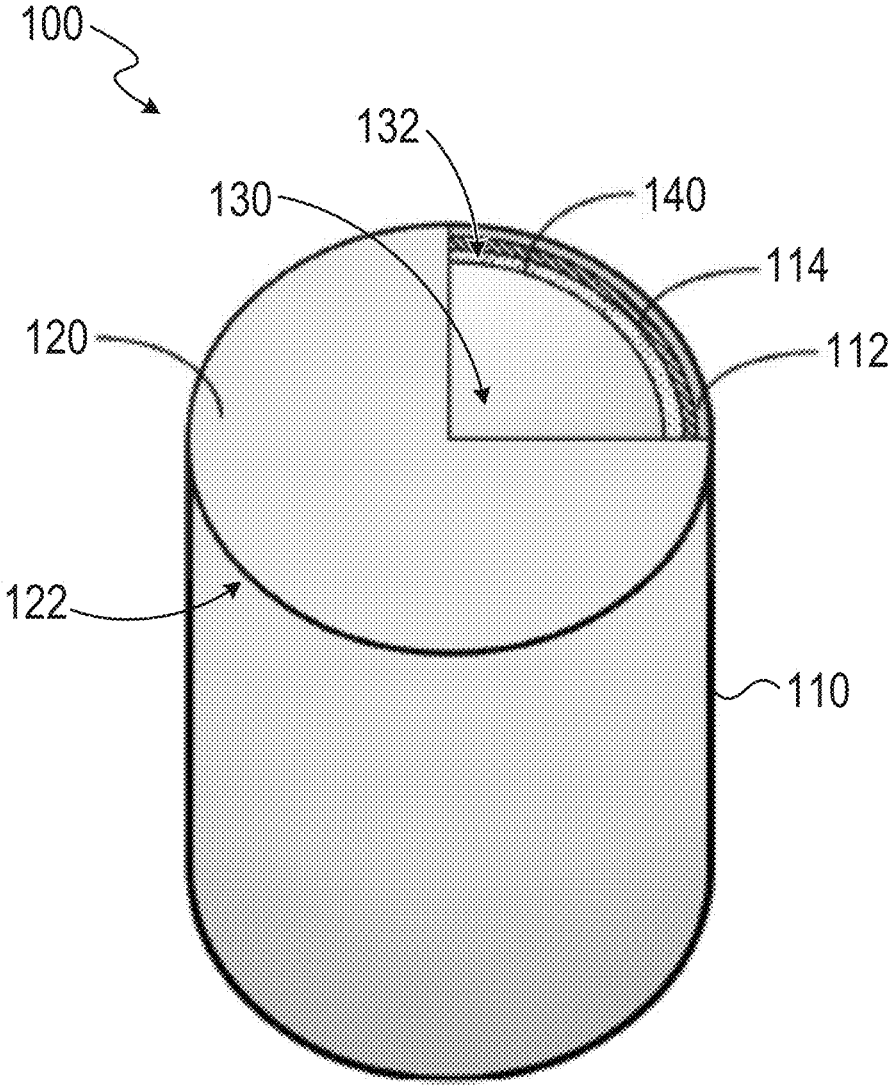
FIG. 1A is a top perspective view of a beverage container configured in accordance with embodiments of the present technology.

The present technology is directed to beverage containers, including cannabinoid, alkaloid, and/or psychedelia compound-infused beverage containers, and associated devices, systems, and methods. Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

The terminology used in the description presented below is intended to be interpreted in its broadest reasonable manner, even though it is being used in conjunction with a detailed description of certain specific embodiments of the present technology. Certain terms may even be emphasized below; however, any terminology intended to be interpreted in any restricted manner will be overtly and specifically defined as such in this Detailed Description section. Additionally, the present technology can include other embodiments that are within the scope of the examples but are not described in detail with respect to FIGS. 1-5.

Reference throughout this specification to "one embodiment" or "an embodiment" means that a particular feature, structure, or characteristic described in connection with the embodiment is included in at least one embodiment of the present technology. Thus, the appearances of the phrases "in one embodiment" or "in an embodiment" in various places throughout this specification are not necessarily all referring to the same embodiment. Furthermore, the particular features or characteristics may be combined in any suitable manner in one or more embodiments. Reference throughout this specification to relative terms such as, for example, "generally," "approximately," and "about" are used herein to mean the stated value plus or minus 10%.

A. Overview

The production and/or quality control of active ingredient beverages (which can also be referred to as "active beverages"), including cannabinoid, alkaloid, and/or psychedelia compound-infused beverages, is significantly challenged by the concentration of some or all of the active ingredients degrading and/or decreasing over time, such as the concentrations dropping below a satisfactory (e.g., effect-inducing) level before being consumed, and/or with issues related to the manufacturing of active beverages, such as emulsification and homogenization, leading to an incorrect quantity (e.g., concentration, dose, dosage, and the like) of active ingredient being introduced into an active beverage container at the outset. Addressing one or more of these problems may improve the customer experience, increase demand for the product, and/or reduce or minimize the likelihood of mistaken/improper dosing. Further, by dosing active ingredients via a beverage container, the regulatory compliance for companies producing such beverages may be simplified as the dosing can be performed at a separate location or isolated to the filling or bottling portion of the production line. Improved dosing can also improve the consistency of the product and can limit or reduce the quantity or overage of active ingredients needed to produce the beverage.

In one aspect of the present technology, a beverage container has an interior cannabinoid liner configured to contact liquid dispensed into the container. The cannabinoid liner can dissolve into the liquid to produce a cannabinoid liquid. The container can hold the cannabinoid liquid for convenient consumption. In some embodiments, a pre-filled beverage container can include one or more doses of active ingredient(s). The active ingredient(s) can be released, for example, when the container is filled with liquid. In some embodiments, the beverage container holds a dose of an active ingredient separated from a contained liquid. When a lid of the container is moved (e.g., rotated relative to a container body, removed, etc.), the active ingredient can be released into the liquid. This allows a user to mix the active ingredient with the liquid immediately before consumption. In at least some aspects, this is expected to improve the consistency of the dose consumed by the user and/or reduce or prevent the likelihood of improper dosing.

In some embodiments, the container includes a container wall forming the sides and bottom of a beverage container, a liner coupled (e.g., bonded, fused, etc.) to the interior surface of the container wall, a cannabinoid coating including at least one cannabinoid, and a lid which may be attached to the container wall to create a sealed container, such that, when a liquid is inserted into the beverage container and the lid is sealed to the container wall, the cannabinoid coating can dissolve and the at least one cannabinoid can mix with the liquid to create a cannabinoid infused beverage.

In some embodiments, a beverage container can include one or more doses of an active ingredient. The active ingredients can be contained in sealed reservoirs (e.g., hermetically sealed reservoirs, fluid-tight reservoirs, thermally insulated reservoirs, etc.), liners, or other components configured to limit or prevent degradation of the active ingredients. For example, the beverage container can include a metal bottle or metal can, a cannabinoid liner, and one or more intermediate layers between the metal surface of the bottle or can and the cannabinoid liner. The intermediate layers (e.g., barrier layers) can prevent cannabinoids from contacting the metal surfaces, thereby preventing cannabinoids (or other active ingredients such as alkaloids) from becoming stuck along the metal surface, generating unwanted byproducts, etc. When a beverage is dispensed into the container, substantially all (e.g., at least 95% by weight, 96% by weight, 97% by weight, 98% by weight, 99% by weight, 99.5% by weight, etc.) of the active ingredient becomes mixed with the beverage. In some embodiments, the active ingredient is isolated from metal surfaces to prevent catalyzing degradative chemistry of the active ingredient and/or the formation of, for example, metal ions, off flavors, etc., in the beverage. In some environments, the container can be made, in whole or in part, of one or more plastics suitable for food contact.

In another aspect of the present technology, a container can be configured to condition the active ingredients throughout the lifetime of a contained composition. The container can include a container wall forming the sides and bottom of the container, a conditioning component configured to releasably contain an active ingredient and to release at least a portion of the active ingredient into the container, and a lid which may be sealably attached to the container wall to create a sealed container. When a liquid is inserted into the beverage container and the lid is sealed to the container wall, the active ingredient is conditioned by the conditioning component unless or until the conditioning component is actuated to cause the active ingredient to mix with the liquid to create a beverage infused with the active ingredient.

In some aspects of the present technology, the active ingredient can include at least one cannabis compound, at least one alkaloid compound, and/or at least one psychedelia compound. A cannabis compound ("the cannabinoid") can include any constituent extracted and/or derived from a plant belonging to the genus *Cannabis*, including one or more cannabinoid compounds, terpenoid compounds, and/or flavonoid compounds, as well as one or more synthetic, semisynthetic, and/or highly purified versions of any such constituent. In at least some embodiments, for example, the active ingredient can include one or more of tetrahydrocannabinolic acid (THCA), cannabidiolic acid (CBDA), cannabidiol (CBD), cannabigerolic acid (CBGA), cannabigerol (CBG), cannabichromenic acid (CBCA), cannabichromene (CBC), cannabinol (CBN), cannabielsoin (CBE), cannabicyclol (CBL), cannabicitran (CBT), any suitable respective isomers and/or human metabolites thereof, combinations thereof, and/or any other suitable active ingredient.

In some aspects of the present technology, the conditioning component can physically separate the active ingredient from the liquid for a period of time, e.g., until an activation event during which the conditioning component is actuated to release at least a portion of the active ingredient. For example, the conditioning component can include a dispensing device configured to contain the active ingredient and operably associated with the lid such that the dispensing device can release at least a portion of the active ingredient when the lid is opened. In these and other embodiments, the conditioning component can be configured to (i) create an equilibrium between the rate/amount of active ingredient migrating into and out of the liquid; (ii) at least partially protect the active ingredient from thermal decomposition;

(iii) at least partially protect the active ingredient from acid-catalyzed degradation; (iv) release enteric-coated microbeads into the contained composition; and/or (v) at least partially protect the active ingredient from oxidation.

In some aspects of the present technology, the activation event can include application of a physical force, a magnetic force, and/or an electromagnetic signal to at least a portion of the container. In at least some embodiments, for example, the activation event can be an electromagnetic signal having a wavelength between about 100-400 nm and about 1-10 cm, or between about 0.1 m to about 1 m. Additionally, or alternatively, the activation event can include one or more enzymes configured to release the active ingredient after a predetermined amount of time. In at least some embodiments, for example, the active ingredient can be contained within one or more coatings (e.g., temporary coatings, enteric coatings, etc.) and the enzymes can degrade or dissolve the coating to release at least a portion of the active ingredient.

In some aspects of the present technology, the conditioning component can include one or more active-ingredient release liners. The liners can be impregnated with or contain at least one active ingredient. The liners can be formed from one or more synthetic materials, such as one or more polyesters, polyorthoesters, polyanhydrides, polyamides, polyesteramides, polyphosphoesters, and/or any other suitable synthetic materials. Additionally, or alternatively, one or more layers of a liner can be made of, in whole or in part, collagen, albumin, gelatin, and polysaccharides, such as agarose, alginate, carrageenan, hyaluronic acid (HA), dextran, chitosan, any suitable analogues thereof, and/or any other suitable material. In these and other embodiments, the conditioning component can further include an active ingredient coating applied to an interior of the container and configured to release at least one active ingredient into a liquid contained therein. In at least some embodiments, for example, the liner can be positioned between the active ingredient coating and an outer wall of the container.

B. Selected Embodiments of Cannabinoid and/or Alkaloid Beverage Containers

FIG. 1A is a top perspective view of a beverage container 100 configured according to embodiments of the present technology. The beverage container 100 can be a bottle, a can, ajar, a carton, a pouch, or any other suitable structure configured to contain a beverage or other fluid. In at least some embodiments, for example, the beverage container 100 is configured to contain a cannabinoid and/or alkaloid-infused beverage. The beverage container 100 may contain, for example, a unit amount (e.g., 8 fl oz, 16 fl oz, 32 fl oz, 1 gallon, etc.) intended to be a single serving or may contain multiple servings of a beverage. The beverage container 100 may include labeling to identify the contents, usage information, dosing information, and/or provide regulatory information associated with the beverage.

In the illustrated embodiment, the beverage container 100 includes a container housing or body 110 and a sealing element or lid 120. The body 110 can include a first or outer layer 112 (which can also be referred to as "the container wall 112") and a second or inner layer 114 (which can also be referred to as "the liner 114"). Additionally, the body 110 can at least partially define a chamber or interior 130 of the beverage container 100 and/or an opening 132 of the interior 130. The lid 120 can be coupled to the body 110 and configured to provide selective access to the interior 130, e.g., via the opening 132. At least a portion of the lid 120 can be configured to form a substantially fluid-impermeable seal 122 with the body 110 such that one or more materials and/or fluids (e.g., a cannabinoid and/or alkaloid-infused beverage) carried within the interior 130 is generally or substantially prevented from leaving the interior 130 unless or until the lid 120 is uncoupled from the body 110 and/or the seal 122 is otherwise broken.

The container wall 112 may include all or part of one or more side and/or bottom surfaces of the beverage container 100, and may additionally include a top surface of the beverage container 100. The container wall 112 may be configured to form the seal 122 mechanically and/or through one or more treatments, coatings, and/or other suitable processes. The container wall 112 can be a structural component of a beverage container 100. In at least some embodiments, for example, the container wall 112 provides structure, protects the contents of the beverage container 100, and/or may additionally form the seal 122 (FIG. 1A). The container wall 112 may be rigid or flexible and may additionally tolerate some deformation before failing under an internally or externally applied force (e.g., a pressure). The container wall 112 may be configured to maintain a pressure differential between the interior and the exterior of the beverage container 100, e.g., such as when containing carbonated beverages. In a representative embodiment, the container wall 112 is comprised of aluminum. In another representative embodiment, the container wall 112 is comprised of plastic such as polyethylene terephthalate glycol (PETG).

The liner 114 can be a material applied to the inside of the beverage container 100 and configured to isolate the contents of the beverage container 100 from, e.g., the container wall 112. The liner 114 may be coupled (e.g., bonded, fused, adhered, etc.) to the container wall 112. In the illustrated embodiment, for example, the liner 114 is coupled to the container wall 112 and positioned between the hollow interior 130 and the container wall 112, e.g., inwardly relative to the container wall 112. In other embodiments, the liner 114 (*i*) may be chemically bonded to the interior of the container wall 112 such as with a plastic, wax, or resin liner 114 coating a cardboard, metal, or plastic container wall 112; (ii) may be mechanically secured utilizing friction or mechanically interlocking features to maintain its position within the beverage container 100; (iii) may be a loose-fitting bladder within the beverage container 100; and/or (iv) may have any other suitable configuration.

The liner 114 can be configured to at least partially prevent the contents of the beverage container 100 from acquiring a metallic taste (e.g., from being in contact with a metal container wall and/or from metal ions migrating from the container wall 112) and/or to at least partially prevent the generally acidic contents of the beverage container from corroding the container wall 112. Similarly, the liner 114 may reduce or prevent off flavors or the leaching of chemical compounds from a plastic or other type of container wall 112. Liners 114 for aluminum beverage containers can be made from plastics, such as polycarbonate, resins, and/or any other suitable materials. In a representative embodiment, the liner 114 is comprised of polycarbonate which is thermally formed or mechanically dispersed onto the inside of a container wall 112 of the beverage container 100. In another representative embodiment, the container wall 112 is comprised of a sheet of aluminum metal and the liner 114 includes polyethylene terephthalate (PET) which has been thermally formed on the inside of the container wall 112. In another representative embodiment, the liner 114 may be formed by a resin which may coat the inside of a container wall 112 before being allowed to cure.

Additionally, or alternatively, the liner 114 may be a dosing liner that is impregnated with one or more active ingredients. For example, the liner 114 may be porous or have a chemical structure wherein active ingredient(s) could temporarily bond to the liner 114 such that, when a liquid is added to the container, at least some of the active ingredients are released from the liner 114 to mix with the liquid. In a representative embodiment, the liner 114 is comprised of porous polycarbonate and the cannabinoid infused within the liner 114 is CBD. In some embodiments, the dosage of active ingredient (e.g., cannabinoid, CBD, THC, CBD and THC, etc.) can be equal to or greater than about 2 milligrams, 3 milligrams, 4 milligrams, 5 milligrams, 6 milligrams, 7 milligrams, 8 milligrams, 9 milligrams, 10 milligrams, 20 milligrams, any amount therebetween, or any other suitable dosage. The dosage can be selected based on the volume of beverage, intended consumption time and/or time period for the beverage, characteristics of active ingredients, user preferences, etc. For example, the dosage can be a daily dosage if the beverage is consumed over a single day. For cannabinoids, a daily dosage can be, for example, 1-5 milligrams for mild effects, 5-15 milligrams for moderate effects, 15-30 milligrams for strong effects, 30-500 milligrams for intense effects, or the like.

In some embodiments, the lid 120 is entirely removable or decouplable from the body 110, such as on a twist top bottle. In other embodiments, the lid 120 includes an immovable component which is securely attached to the body 110 and a movable or removable component which creates an opening or port in the lid 120 and through which the beverage may be removed from the interior 130 of the beverage container 100 (e.g., during consumption by the user). The movable component may actuate once and remain open thereafter or may toggle between an open and closed position. The removable component may be permanently separated or may be resealable. One or more portions of the beverage container 100 (e.g., the body 110, the first layer 112, the second layer 114, the lid 120, etc.) may be formed at least partially from one or more materials, such as a metal (e.g., including aluminum or tin), metal alloy (e.g., an alloy of metals including stainless steel), glass, rigid plastics, coated cardboards, plastics, foils, multiple layers of one or more of the preceding materials, and/or any other suitable material or combination of materials.

Figure 1B:
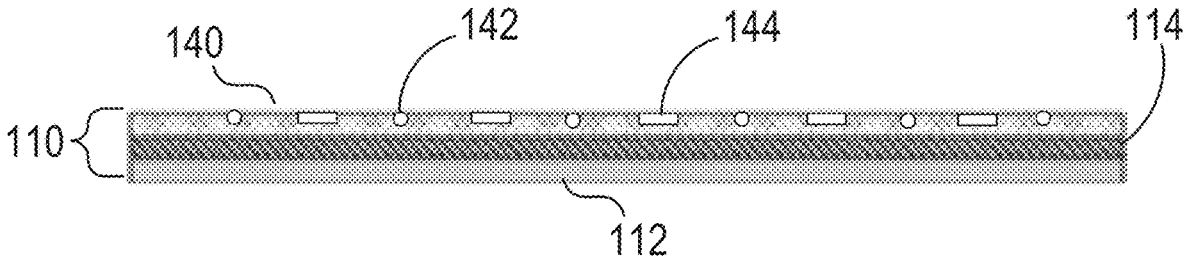
FIG. 1B is a cross-sectional view of a housing of the beverage container of FIG. 1A.

FIG. 1B is a side cross-sectional view of the body 110 of the beverage container 100. Referring to FIGS. 1A and 1B together, the beverage container 100 further includes an active ingredient coating 140 (which can also be referred to as "the coating 140," "the active ingredient 140," "the active ingredient component 140," "the active component 140," or the like). The coating 140 may be dry, liquid, and/or formed of a pressed solid which may dissolve in a liquid added to the beverage container 100. The coating 140 may cover the entire internal surface area of a beverage container 100 or may only cover a portion of the internal surface area of the beverage container 100. For example, the coating 140 can be applied to all or part of the liner 114, the container wall 112, the lid 120, and/or any other suitable portion of the beverage container 100. In at least some embodiments, the coating 140 is the innermost layer of the body 110 such that the coating 140 interacts with/directly contacts a liquid beverage added to the beverage container 100. In some embodiments, the beverage container 100 includes the coating 140 and the liner 114 is omitted. In other embodiments, the liner 114 is impregnated with one or more active ingredients and the coating 140 is omitted. In further embodiments, both the liner 114 impregnated with the cannabinoids and/or alkaloids and the coating 140 may be utilized simultaneously, e.g., to reduce or minimize the effect of interactions between the beverage container 100 and the active ingredient(s) when a liquid beverage is added to the beverage container 100.

At least some of the coatings 140 and/or the active ingredient-infused liners 114 of the present technology are expected to (i) be generally stable under at least ambient storage conditions, (ii) be less likely to undergo degradative chemical reactions, and/or (iii) have a reduced rate of active ingredient concentration loss. Additionally, when a beverage is dispensed into the beverage container 100, substantially all (e.g., at least 95% by weight, 96% by weight, 97% by weight, 98% by weight, 99% by weight, 99.5% by weight, etc.) of the active ingredient is expected to mix with the beverage. In at least some aspects, this is expected to improve the consistency of the dose consumed by the user and/or reduce or prevent the likelihood of improper dosing.

The coating 140 can include at least one active ingredient 142 (shown schematically in FIG. 1B), such as at least one cannabinoid, at least one alkaloid, and/or at least one psychedelia compound, and a binder 144 (shown schematically in FIG. 1B). The binder 144 can be configured to at least partially adhere the active ingredient 142 to the container wall 112 and/or the liner 114. The binder 144 can include one or more materials that help the cannabinoids, alkaloids, and/or psychedelia compounds in the coating 140 to adhere to the container wall 112, such as starch, glucose, and/or any other suitable material. Additionally, or alternatively, the binder may aid the impregnation of the active ingredient such that the active ingredient becomes trapped within or otherwise bonded to a liner 114. In at least some embodiments, the binder 144 can be a food safe and/or dissolvable material and can be mixed with an active ingredient (e.g., a cannabinoid, an alkaloid, and/or a psychedelia compound) to facilitate packaging and delivery of the active ingredient. The binder 144 can include (i) one or more synthetic polymers, such as polyethylene glycol, polyvinylpyrrolidone (PVP), polyvinyl alcohol; (ii) one or more natural polymers such as starch, glucose, cellulose ethers, edible carnauba wax, guar gum, pectin, xanthan gum; (iii) a combination thereof; and/or (iv) any other suitable material or combination of suitable materials. The binder 144 may be, for example, a liquid or a powder and may be mixed with a solvent, such as water or alcohol, to facilitate application to the beverage container 100.

In some embodiments, a linker may be used together or in lieu of the binder 144. The binder 144 and/or linker can be composed of non-naturally occurring materials used for extended release formulations, such as one or more polyesters, polyorthoesters, polyanhydrides, polyamides, polyesteramides, polyphosphoesters, and/or any other suitable non-naturally occurring materials. Alternatively, or in addition, the binder 144 and/or linker can be composed of one or more naturally occurring biopolymers, whether produced biosynthetically or via chemical synthesis, such as collagen, albumin, gelatin, one or more polysaccharides, such as agarose, alginate, carrageenan, hyaluronic acid (HA), dextran, nucleic acid oligomers, chitosan, their respective derivatives, or any other suitable naturally occurring biopolymers. Alternatively, or in addition, the linker can be composed of one or more materials generally used for enteric coatings, which undergo a change in physical or chemical properties due to changing levels of acidity/basicity or enzymatic action, such as at least one of methyl acrylate-methacrylic acid copolymers, cellulose acetate phthalate (CAP), cellulose acetate succinate, hydroxypropyl methylcellulose phthalate, hydroxypropyl methylcellulose acetate succinate (hypromellose acetate succinate), polyvinyl acetate phthalate (PVAP), methyl methacrylate-methacrylic acid copolymers, shellac, cellulose acetate trimellitate, and/or any other suitable enteric coating material.

In at least some embodiments, the body 110 is comprised of an aluminum container wall 112, a liner 114 made of high-density polyethylene (HDPE) and a coating 140 comprised of CBD and glucose. In these and other embodiments, the coating 140 may additionally include natural or synthetic flavor compounds. The coating 140 can be added to the inside of the container wall 112 and allowed to dry. After a liquid has been added to the beverage container 100, the coating 140 can dissolve into solution within the liquid, e.g., to release the active ingredient and form the active beverage. In some embodiments, the dissolution of the coating 140 can be aided by thermal stimulus, mechanical stimulus, magnetic stimulus, electromagnetic stimulus, any other stimulus described herein, and/or any other suitable stimulus or other activation event/parameter, as described in greater detail below with reference to FIGS. 2-4. In other embodiments, the coating 140 is configured such that the coating 140 does not dissolve upon addition of liquid but instead acts as an impedance barrier to at least partially prevent active ingredients 142 (e.g., cannabinoid(s), alkaloid(s), psychedelia compound(s), or combinations thereof) from migrating into the coating 140 or liner 114 by at least partially neutralizing or reversing one or more equilibrium forces that permit migration. In a representative embodiment, the coating 140 is comprised of CBD and a binder 144 comprising a 50/50 mixture of corn starch and glucose. In these and other embodiments, the number of layers (e.g., first layer 112, second layer 114, coating 140, and the like), composition of the layers, functionality of layers, etc. can be selected based on, for example, the composition and number of the active ingredients, characteristics of the beverage (e.g., temperature of beverage, composition of beverage, etc.), properties of container, beverage storage time (e.g., time from mixing to consumption), combinations thereof, or the like.

In some embodiments, the active ingredient can include one or more cannabinoids, including one or more compounds naturally occurring in the cannabis plant and/or synthetically or biosynthetically produced analogues, such as one or more constituents extracted and/or derived from a plant belonging to the genus *Cannabis*, including, but not limited to, one or more cannabinoid compounds, terpenoid compounds, and/or flavonoid compounds, as well as one or more synthetic, semisynthetic, and/or highly purified versions of any such constituent. In at least some embodiments, for example, the cannabinoid includes one or more of: cannabigerolic acid (CBGA), cannabigerolic acid monomethylether (CBGAM), cannabigerol (CBG), cannabigerol monomethylether (CBGM), cannabigerovarinic acid (CBGVA), cannabigerovarin (CBGV), cannabichromenic acid (CBCA), cannabichromene (CBC), cannabichromevarinic acid (CBCVA), cannabichromevarin (CBCV), cannabidiolic acid (CBDA), cannabidiol (CBD), Δ6-cannabidiol (Δ6-CBD), cannabidiol monomethylether (CBDM), cannabidiol-C4 (CBD-C4), cannabidivarinic acid (CBDVA), cannabidivarin (CBDV), cannabidiorcol (CBD-C1), tetrahydrocannabinolic acid A (THCA-A), tetrahydrocannabinolic acid B (THCA-B), tetrahydrocannabinol (THC or Δ9-THC), Δ8-tetrahydrocannabinol (Δ8-THC), Δ10-tetrahydrocannabinol (Δ10-THC), tetrahydrocannabinolic acid C4 (THCA-C4), tetrahydrocannabinol C4 (THC C4), tetrahydrocannabivarinic acid (THCVA), tetrahydrocannabivarin (THCV), Δ8-tetrahydrocannabivarin (Δ8-THCV), Δ9 tetrahydrocannabivarin (Δ9-THCV), tetrahydrocannabiorcolic acid (THCA-C1), tetrahydrocannabiorcol (THC-C1), delta-7-cis-iso-tetrahydrocannabivarin, Δ8-tetrahydrocannabinolic acid (Δ8-THCA), Δ9-tetrahydrocannabinolic acid (Δ9-THCA), cannabicyclolic acid (CBLA), cannabicyclol (CBL), cannabicyclovarin (CBLV), cannabielsoic acid A (CBEA-A), cannabielsoic acid B (CBEA-B), cannabielsoin (CBE), cannabinolic acid (CBNA), cannabinol (CBN), cannabinol methylether (CBNM), cannabinol-C4 (CBN-C4), cannabivarin (CBV), cannabinol-C2 (CBN-C2), cannabiorcol (CBN-C1), cannabinodiol (CBND), cannabinodivarin (CBDV), cannabitriol (CBT), 11-hydroxy-Δ9-tetrahydrocannabinol (11-OH-THC), 11-nor-9-carboxy-Δ9-tetrahydrocannabinol, ethoxy-cannabitriolvarin (CBTVE), 10-ethoxy-9-hydroxy-Δ6a-tetrahydrocannabinol, cannabitriolvarin (CBTV), 8,9-dihydroxy-Δ6a(10a)-tetrahydrocannabinol (8,9-Di-OH-CBT-C5), dehydrocannabifuran (DCBF), cannabifuran (CBF), cannabichromanon (CBCN), cannabicitran (CBT), 10-oxo-Δ6a(10a)-tetrahydrocannabinol (OTHC), Δ9-cis-tetrahydrocannabinol (cis-THC), cannabiripsol (CBR), 3,4,5,6-tetrahydro-7-hydroxy-alpha-alpha-2-trimethyl-9-n-propyl-2,6-methano-2H-1-benzoxocin-5-methanol (OH-iso-HHCV), trihydroxy-delta-9-tetrahydrocannabinol (triOH-THC), yangonin, epigallocatechin gallate, dodeca-2E,4E,8Z,10Z-tetraenoic acid isobutylamide, hexahydrocannabinol, dodeca-2E,4E-dienoic acid isobutylamide, and/or any combination thereof. The cannabinoid may additionally include any compound derived from a cannabinoid such as through the process of decarboxylation, oxidation, reduction, cyclization, or salt formation. In these and other embodiments, the cannabinoid can include any other suitable cannabinoid.

In some embodiments, the active ingredient includes one or more alkaloids, including one or more compounds naturally occurring in a botanical product, such as any compound containing at least one nitrogen atom, and synthetically or biosynthetically produced analogues thereof. In at least some embodiments, for example, the alkaloid includes one or more of 4-bromo-2,5-dimethoxyphenethylamine, 2,5-dimethoxy-4(n)-propylthiophenethylamine, N-benzylpiperazine, dimethyltryptamine, 5-methoxy-dimethyltryptamine, 4-methyl-2,5-dimethoxyamphetamine, lysergic acid diethylamide, 4-methyl-2,5-dimethoxyamphetamine, 3,4-methylenedioxyamphetamine, 3,4-methylenedioxy-N-ethylamphetamine, 3,4-methylenedioxymethamphetamine, 1-methyl-4-phenyl-4-propionoxypiperidine, 1-piperidinocyclohexanecarbonitrile, N-ethyl-1-phenylcyclohexylamine, 1-phenylcyclohexylamine, 1-(1-phenylcyclohexyl)piperidine, (−)-1-dimethylamino-1,2-diphenylethane, 1-[1-(2-Thienyl)cyclohexyl]piperidine, psilocybin, psilocin, mitragynine, 7-hydroxymitragynine, salvinorin A-F and G, harmine, harmaline, and/or any combination thereof. In other embodiments, the alkaloid can include any other suitable alkaloid.

In some embodiments, the active ingredient includes one or more psychedelia compounds, including any constituent extracted and/or derived from a plant, fungi, or animal belonging to the genuses: *Acacia, Alchornea, Amanita, Amsonia, Anadenanthera, Apocynum, Areca, Argyreia, Artemisia, Arundo, Aspidosperma, Banisteriopsis, Burkea, Calea, Calligonum, Calycanthus, Catha, Carex, Claviceps, Copelandia, Datura, Delosperma, Desfontainia, Desmanthus, Desmodium, Dictyoloma, Diplopterys, Dutaillyea, Echinopsis, Elaeagnus, Erigonum, Erythroxylum, Festuca, Guiera, Gymnacranthera, Hammada, Heimia, Horsfieldia, Ilex, Ipomoea, Iryanthera, Leonotis, Leptactinia, Lespedeza,*

*Limonia, Lolium, Lophophora, Meconopsis, Melicope, Mimosa, Mitragyna, Mucuna, Nectandra, Newbouldia, Nicotiana, Nymphaea, Opuntia, Osteophloem, Panaeolus, Pandanus, Papaver, Passiflora, Pauridiantha, Peganum, Petalostylis, Phalaris, Phyllodium, Phyllomedusa, Picrasma, Pilocarpus, Plectocomiopsis, Prosopis, Psilocybe, Psychotria, Punica, Rhinella, Rivea, Salvia, Shepherdia, Simira, Strychnos, Tabernaemontana, Tabernanthe, Testulea, Tetradium, Trachelospermum, Tribulus, Uncaria, Urtica, Vepris, Vestia, Vinca, Virola, Voacanga, Zanthoxylum*, and/or *Zygophyllum*. In some embodiments, the psychedelia compound can include one or more compounds in the following chemical classes: arylcyclohexylamines, beta-carbolines, cathinones, ergolines, indole alkaloids, lysergamides, methylxanthine alkaloids, muscimol (and precursors), phenethylamines, salvinorins, tryptamines, Phyllomedusa peptides, and/or any other suitable compound or class of compounds, including any compound categorized as a "hallucinogenic substance" in schedules 1-5 of the United States Controlled Substance Act, and/or any suitable analogues of one or more of the psychedelia compounds provided herein. Additionally, or alternatively, the psychedelia compound can include any compound(s) and/or formulation(s) that exhibit central nervous system (CNS) activity at one or more adenosinergic receptors, adrenergic receptors, cannabinergic receptors, dopaminergic receptors, GABA receptors, NMDA receptors, norepinephrine receptors, and/or serotoninergic (e.g., 5-HT2A and/or 5-HT1A) receptors. In these and other embodiments, the psychedelia compound can include any other suitable psychedelia compound.

Figure 2:
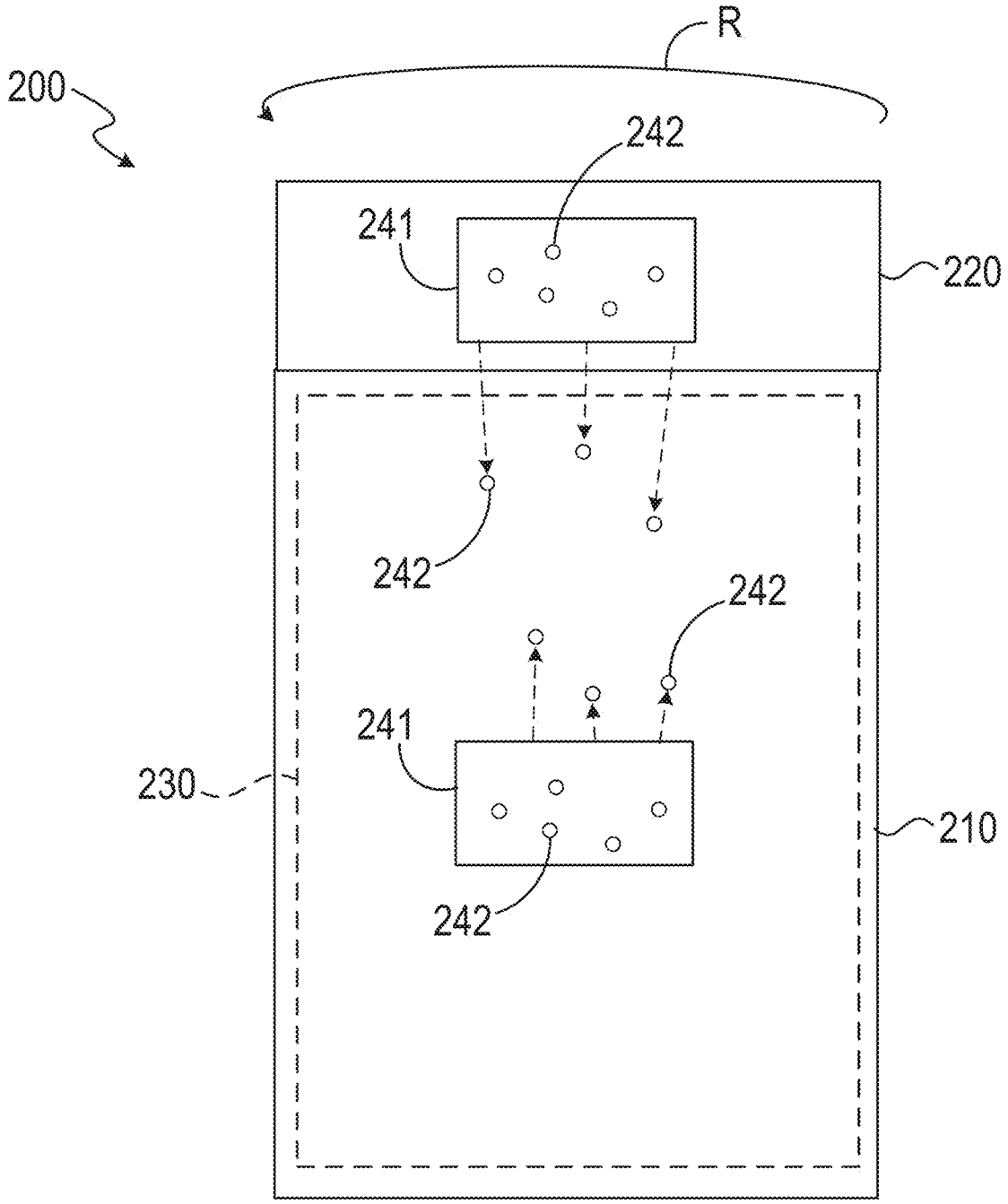
FIG. 2 is a schematic side view of another beverage container configured in accordance with embodiments of the present technology

FIG. 2 is a schematic side view of a beverage container 200 configured in accordance with embodiments of the present technology. The beverage container 200 can be generally similar to the beverage container 100 of FIGS. 1A and 1, with like numbers (e.g., the body 210 versus the body 110 of FIGS. 1A and 1*i*). Additionally, the beverage container 200 can include one or more active ingredient releasing or conditioning components 241. In the illustrated embodiment, both the lid 220 and the body 210 of the beverage container 200 include respective conditioning component 241. In other embodiments, the lid 220 and/or the body 210 can include more or fewer conditioning components 241.

The conditioning components 241 can be configured to contain all or part of the active ingredient(s) 242 (e.g., shown using dashed-line arrows in FIG. 2), such as a cannabinoid, alkaloid, and/or psychedelia compound, and can be actuated to release the active ingredient 242 into the interior 230 (shown in dashed-line) of the beverage container 200. Additionally, the conditioning component 241 can be configured to reduce or minimize degradation/concentration loss of the active ingredient 241 contained therein. In at least some embodiments, for example, the conditioning component 241 can be configured to at least partially or fully prevent the active ingredient 242 contained therein from mixing with a fluid carried within the beverage container, e.g., unless or until the conditioning component 241 is actuated to release all or part of the active ingredient 242. Individual ones of the conditioning components 241 can include, for example, a beverage widget including a chamber or surface configured to contain the active ingredient 242 and separate the active ingredient 242 from the beverage until the beverage container 200 is opened (e.g., for consumption). In these and other embodiments, each of the conditioning components 241 can be operably coupled to the lid 220, such that opening the lid 220 can actuate at least one of the conditioning components 241 and release all or part of the associated active ingredient 242. For example, at least one of the conditioning components 241 can be configured to release at least a portion of the active ingredient 242 when the lid 220 is rotated (e.g., as shown by arrow R in FIG. 2) relative to the body 210, such as by puncturing or forming an opening in a chamber of the conditioning component 241. In some embodiments, the lid 220 can be sequentially rotated to sequentially dispense individual doses of the active ingredient 242. This can allow a user to refill the beverage container 200 and then dispense additional/subsequent doses into the beverage container 200. The number of individually dispensable doses contained by the beverage container 200 can be selected based on the number of mixtures to be produced by the beverage container 200. As another example, the lid 220 can include a tab that can be actuated to form an opening in the lid 220, and at least one of the conditioning components 241 can include an at least partially frangible or otherwise breakable element operably coupled to the tab, such that the tab can puncture/break the frangible element when the tab is actuated.

FIG. 3 illustrates a table 350 (which can also be referred to as "the application table 350", "the activation table 350," "the activation database 350," "the active ingredient application and/or activation parameter table 350," and the like) in accordance with embodiments of the present technology. The table 350 includes active ingredient application types, methods, and/or parameters for the application and/or dissolution of a coating (e.g., the coating 140 of FIGS. 1A and 1B) and other compositions during the treating of a beverage container (e.g., the beverage container 100 of FIGS. 1A and 1B and/or the beverage container 200 of FIG. 2) and/or the mixing of a liquid with the cannabinoid and/or other active ingredient compositions within a beverage container. Thus, in some embodiments, table 350 may be iteratively updated based on a plurality of trials of a dosing method 460 (described in greater detail below with reference to FIG. 4) to determine activation parameters for a plurality of beverage types, activation methods, beverage container types, and activation parameters. Although the table 350 is described with reference to the beverage container 100, the beverage container 200, and/or one or more of the respective components thereof (e.g., the liner 114 of beverage container 100, the conditioning component 241 of the beverage container 200), it will be appreciated that the table 350 can be applied to any other suitable beverage container and/or suitable component thereof.

The table 350 can include one or more representative parameters 354 for one or more processes or application types 352 for applying active ingredient(s), including one or more cannabinoids, alkaloids, psychedelia compounds, and/or combinations thereof, to the interior of the beverage container 100, 200. In the illustrated embodiment, the application types 352 include (i) a coating discrete from the structure of a beverage container 100 (such as the coating 140 of FIGS. 1A and 1), (ii) impregnating the liner 114 with at least one active ingredient (such as described previously regarding FIGS. 1A and 1), (iii) a combination of impregnating the liner 114 with at least one active ingredient and applying a discrete coating (such as described previously regarding FIGS. 1A and 1), and (iv) a widget configured to releasing the active ingredient prior to beverage consumption. In these and other embodiments, the application types can include any other suitable process or technique for applying a coating 140 to the interior of the beverage container 100, 200. The parameters 354 associated with a given application type may vary based at least partially on (i) the type of active ingredient(s), (ii) the thickness of the coating 140, (iii) the type of binder used in the coating 140, (iv) the size/dimension(s) of the widget (such as the conditioning component 241 of FIG. 2), and/or (v) the characteristics of the liquid (e.g., taste, temperature, viscosity, interaction with active ingredient, etc.) being added to the beverage container 100, 200, and the like.

The parameters 354 indicate some conditions/stimuli in response to which the active ingredient 142, 242 can be released (e.g., from the coating 140 and/or the conditioning component 241) into a liquid added to the beverage container 100, 200. It will be appreciated that one or more of the parameters 354 may vary based on, e.g., the number of layers, composition of the layers, functionality of layers, the composition and number of the active ingredients, characteristics of the beverage (e.g., temperature of beverage, composition of beverage, etc.), properties of container, beverage storage time (e.g., time from mixing to consumption), combinations thereof, or the like. In the illustrated embodiment, the parameters 354 include temperature, pH, and the type and/or duration of other forms of stimuli (e.g., physical force/agitation, passive diffusion, magnetic force, electromagnetic signal, enzyme). In other embodiments, the parameters 354 can include any other suitable parameters. In these and other embodiments, it is expected that the target saturation of active ingredient(s) within the beverage can be achieved by using the application type 352 and the associated parameters 354. The parameters 354 can be manually determined/revised based on the characteristics of the type of application, materials utilized, and characteristics of the added liquid. In some embodiments, the parameters 354 may be automatically determined/revised, e.g., by a software algorithm, such as, for example, an algorithm which interprets test results from a dosing method (e.g., dosing method 460, which is described in greater detail below regarding FIG. 4).

Figure 4:
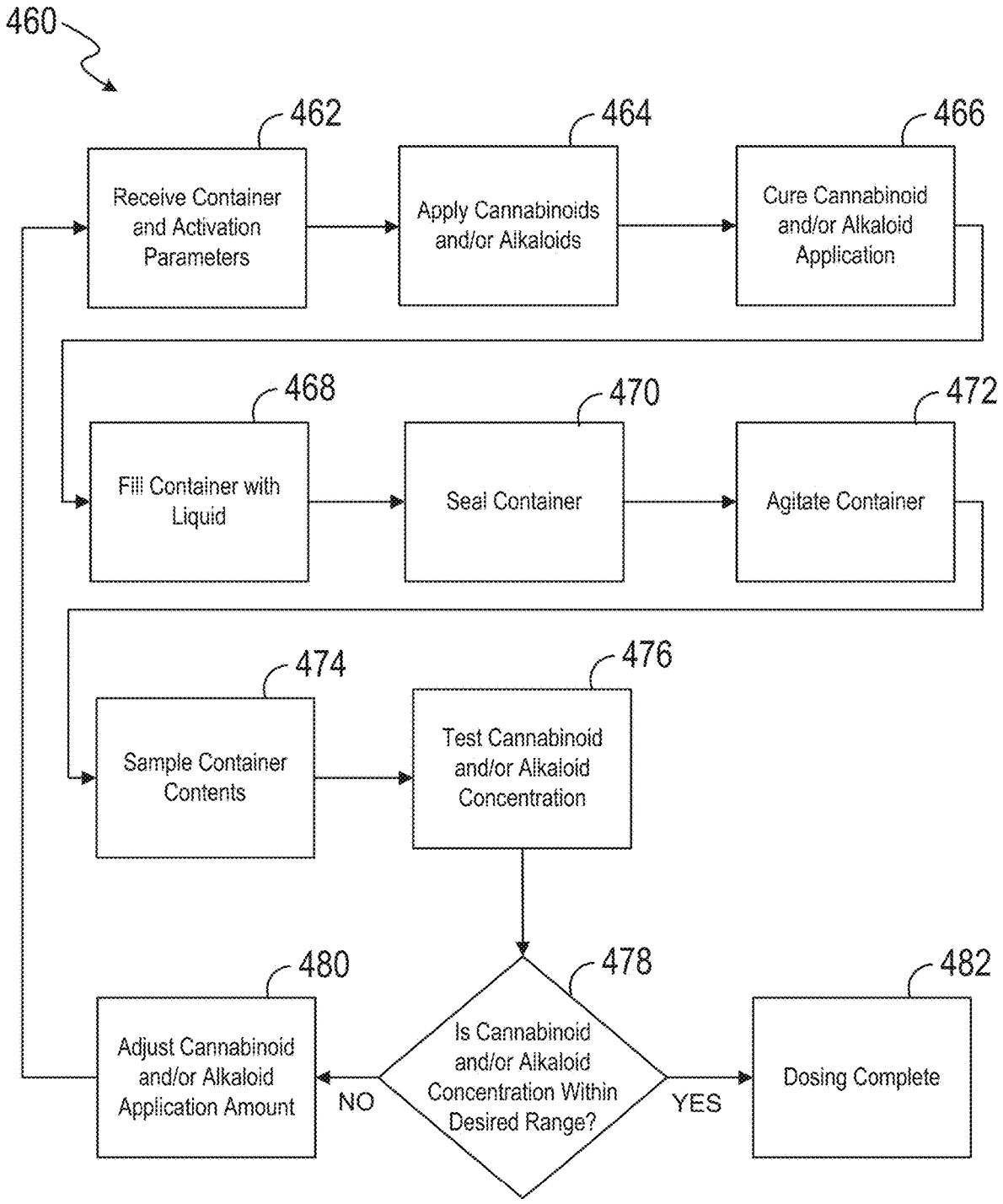
FIG. 4 is a flow diagram of a method in accordance with embodiments of the present technology.

FIG. 4 is a flow diagram of a dosing method 460 in accordance with embodiments of the present technology. The dosing method 460 can be used for manufacturing a beverage container (e.g., the beverage container 100 of FIGS. 1A and 1B and/or the beverage container 200 of FIG. 2) for containing a beverage including an active ingredient (e.g., the active ingredient 142 of FIG. 1B and/or the active ingredient 242 of FIG. 2). In at least some embodiments, for example, the dosing method 460 can be used to determine the active ingredient(s) (e.g., number of active ingredients, amount of active ingredients, formation of active ingredients, excipients, etc.) to apply to a given beverage container and/or a given liquid to create a beverage with a desired concentration of cannabinoids, alkaloids, and/or other active ingredients. The dosing method 460 can be based at least in part on one or more of the parameters 354 from the table 350 (FIG. 3). In some embodiments, the dosing method 460 can be used iteratively to update/revise one or more of the parameters 354, e.g., based on the results from testing the concentration of the cannabinoids in the final beverage after the activation of the beverage container has been completed. The parameters 354 may be similarly updated when the dosing method 460 is utilized as a quality control step in a batch or continuous manufacturing process. Although various aspects of the method 460 are described with reference to the beverage containers 100, 200 and/or one or more of the components thereof (e.g., the liner 114, the conditioning component 241, and the like), it will be appreciated that the method 460 can be applied to any other suitable beverage container.

The dosing method 460 begins at block 462 with receiving a beverage container 100, 200 and retrieving activation parameters 354 for the beverage container 100, 200 from the table 350, then positioning the beverage container 100, 200 to receive an application of active ingredient 142, 242 (e.g., cannabinoids, alkaloids, and/or psychedelia compounds) based, at least in part, on the retrieved activation parameters from the table 350. In an embodiment, the container is an aluminum beverage can with a liner 114 comprised of a coating of a modified polyester applied to the interior of the container wall 112, and the activation parameters 354 include an activation method (e.g., temperature) and an application type (e.g., impregnated), resulting in a specific activation parameter (e.g., >90° C.). In an alternate embodiment, the beverage container 100, 200 is comprised of plastic such as polyethylene terephthalate glycol (PETG). In a further embodiment, the beverage container 100, 200 is a bottle formed of glass. In these and other embodiments, the beverage container 100, 200 can include one or more conditioning components 241 configured to receive the active ingredient 142, 242.

At block 464, the method 460 can continue by applying the active ingredient 142, 242. In some embodiments, applying the active ingredient can include applying the active ingredient to the interior (e.g., the liner 114) of the beverage container 100, 200. Additionally, or alternatively, applying the active ingredient can include depositing the active ingredient within or otherwise at least partially filling a conditioning component 241 of the beverage container 100, 200 with the active ingredient. The active ingredient can be applied as a solution or mixture of cannabinoids and/or alkaloids which may additionally include a binder 144, e.g., to form the coating 140. A liquid such as water or alcohol may be added to the active ingredient 142, 242 and the binder 144 composition to create a slurry or mixed phase liquid which may improve the application of the cannabinoid or alkaloid composition to the beverage container 100, 200. In an embodiment, the active ingredient includes cannabinoids including CBD and THC and is applied as part of a composition including a binder 144 comprised of a 50/50 mixture of corn starch and glucose in a solution of alcohol. In such embodiments, the amount of CBD applied to the inside of one beverage container can be 160 milligrams, or any other suitable amount.

At block 466, the method 460 can continue by curing the applied (block 464) active ingredient such that the active ingredient or the coating 140 reside in or on the liner 114 or container wall 112. The curing process may include a period of time during which the beverage container 100, 200 is in a low humidity environment, and may additionally include heating the beverage container 100, 200 to dry the coating 140 such that the coating 140 can be stable under ambient storage conditions. In an embodiment, curing the coating 140 can include placing the beverage container 100, 200 in an environment of less than 30% humidity at a temperature between 40 and 50 degrees Celsius for five minutes after the application (block 364) of the coating 140. In these and other embodiments, block 466 can include tilting and/or rotating the beverage container 100, 200 to increase the likelihood of a generally or substantially uniform or even distribution of the coating 140 within the interior of the beverage container 100, 200. In some embodiments, a preformed liner 114 can be coupled to the container wall 112 using, for example, an adhesive, a curing process, etc. In some embodiments, a spraying process can be used to form the liner 114.

At block 468, the method 460 can continue by filling the beverage container 100, 200 with a liquid such as water, a prepared beverage which may be any of a juice, carbonated beverage, etc., or a mixture of multiple liquids. The liquid can be added after the beverage container 100, 200 has been treated with an active ingredient (e.g., block 364 and/or block 366). Accordingly, the added liquid can contact the coating 140 and/or an impregnated liner 114. In an embodiment, the liquid is a fruit juice such as apple juice. In other embodiments, the liquid can be any other suitable liquid.

At block 470, the method 460 can continue by sealing the beverage container 100, 200, e.g., such that the beverage container 100, 200 may be rotated in any direction and little to no liquid can escape. Similarly, if the beverage container 100, 200 contains a carbonated beverage, there can be a pressure differential between the interior and exterior of the beverage container 100, 200. In at least some embodiments, sealing the beverage container 100, 200 can include coupling a lid (e.g., the lid 120, 220) to the beverage container 100, 200. In such embodiments, an interior surface of the lid may also be coated by a liner, such as the liner 114 and/or a coating, such as the coating 140. In an embodiment, the beverage container 100, 200 is an aluminum beverage can, and the lid 120, 220 is stamped aluminum which is affixed to the top of the container wall 112 by mechanically crimping the top of the container wall 112 around the edge of the lid 120. In other embodiments, the lid 120, 220 can have any other suitable configuration and can be applied using any other suitable process or technique.

At block 472, the method 460 can continue by agitating the beverage container 100, 200 to aid the dissolution and/or mixing of active ingredient from the coating 140 and/or the liner 114 into the liquid, e.g., to create a completed, active ingredient-infused beverage. The container 100, 200 may be agitated by mechanical agitation, thermal agitation, or any other suitable agitation process or technique to increase the likelihood that the liquid and the active ingredient are adequately mixed. In some embodiments, the beverage container 100, 200 may be agitated after it has been filled with a liquid and sealed. In other embodiments, the contents of the beverage container 100, 200 may be agitated prior to the beverage container 100, 200 being sealed. In at least some embodiments, the sealed beverage container 100, 200 is physically shaken at a rate of at least 100 oscillations per minute for 2 minutes.

At block 474, the method 460 can continue by collecting a sample of the contents of the beverage container 100, 200. Collecting the sample can include at least partially opening the beverage container 100, 200 which may include removing all or part of the container's lid 120, 220. Alternatively, a portion of the lid 120, 220 may be articulated but not removed from the beverage container 100, 200. In at least some embodiments, for example, the beverage container 100, 200 is a 12 oz. aluminum beverage can, and the can is opened by actuating the tab on the top of the lid 120, 220 which forces a part of the can lid 120, 220 into the can, allowing the contents contained within the can to be accessed. In these and other embodiments, collecting the sample can include removing an amount of the liquid from the beverage container 100, 200 (via, e.g., a manual or automated method) for analysis of at least the concentration of active ingredient 142, 242 in the beverage container 100, 200 contents. For example, collecting the sample can include sampling 100 ml of liquid from the beverage container 100, 200 using a syringe, or any other suitable sample collecting process or technique.

At block 476, the method 460 can continue by testing the concentration of the active ingredient 142, 242 in the liquid sample (block 474). The concentration may be tested to target a specific compound contained within the active ingredient and can include using a test strip, an assay, or generalized methods such as analytical chromatography and/or mass spectrometry to analyze the complete composition of the liquid. In at least some embodiments, for example, gas chromatography is used to determine that the concentration of CBD in the liquid sample is 12 milligrams per ounce. In these and other embodiments, testing the concentration can include using any other suitable concentration testing process or technique.

At block 478, the method 460 can continue by checking whether the active ingredient concentration (block 476) is within a desired range. The desired range can be predefined with the lowest bound of the range comprising at least enough of the active ingredient being assessed to provide a lowest acceptable effect to a person consuming the liquid but not greater than an amount that might cause harm or negative effects (i.e., greatest acceptable effect) on a person consuming the liquid. In at least some embodiments, for example, the desired range is between about 2 milligrams of CBD per ounce and about 5.5 milligrams of CBD per ounce.

If the active ingredient concentration is not within the desired range (block 478—NO), the method 460 can continue at block 480 by adjusting the amount of the active ingredient added to the beverage container 100, 200, returning to block 462, and repeating one or more of the blocks of the method 460. If the active ingredient concentration is below the desired range, adjusting the amount of the active ingredient can include increasing the amount of active ingredient applied to the beverage container 100, 200. If the active ingredient concentration is above the desired range, adjusting the amount of the active ingredient can include decreasing the amount of active ingredient applied to the beverage container 100. The adjustment to the amount of active ingredient may be a percentage of a previously applied amount and/or may be a fixed amount. In at least some embodiments, for example, the tested (block 476) active ingredient concentration is 1.5 milligrams of CBD per ounce which is below a 2 milligrams of CBD per ounce minimum of the desired range (block 478). In such embodiments, block 480 can include increasing the amount of CBD applied per beverage container from 18 milligrams to 24 milligrams returning to block 362, and repeating one or more blocks of the method 360 by, e.g., applying (block 464) the adjusted cannabinoid composition to another beverage container 100, 200 and testing (block 476) the adjusted cannabinoid concentration of the resulting beverage.

If the active ingredient concentration is within the desired range (block 478—YES), the method 460 can continue at block 482 by determining that the dosing process 460 is complete. The steps/blocks of the dosing method 460 described herein are expected to provide a repeatable manufacturing process which can be automated for large volumes of throughput. The dosing method 460 may further be used as a quality check for a sample of a high throughput manufacturing process (e.g., 1 container in each 1000 manufactured). In some embodiments, the dosing method 460 may be used as an inline process for an automated quality check system.

Figure 5:
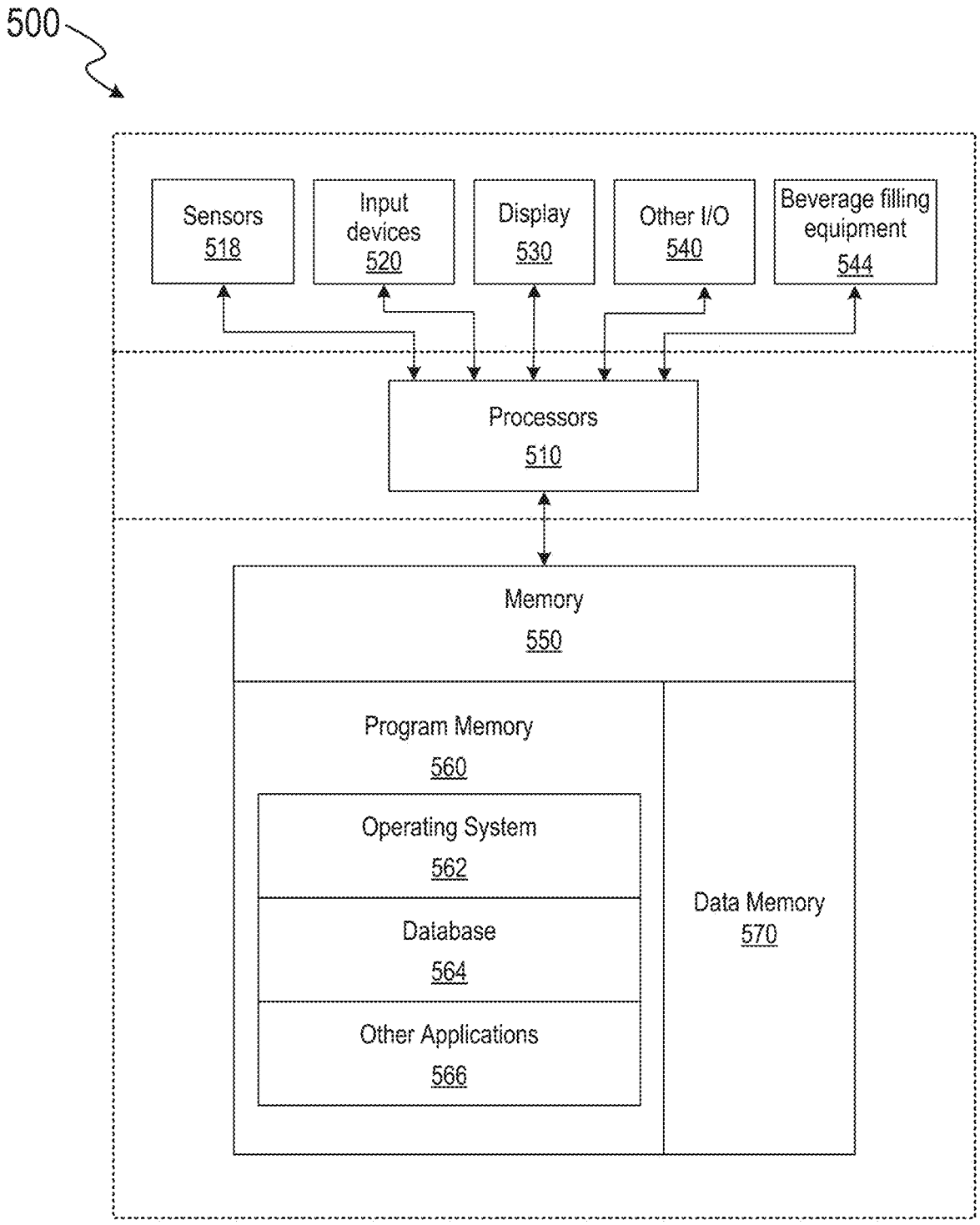
FIG. 5 is a block diagram illustrating an overview of a system on which some implementations of the disclosed technology can operate in accordance with some embodiments.

FIG. 5 is a block diagram illustrating an overview of a system 500 on which some implementations of the disclosed technology can operate. The system 500 can include one or more sensors 518 and input devices 520 that provide input to the processor(s) 510 (e.g., CPU(s), GPU(s), HPU(s), etc.), providing notification of, for example, adverse event(s), operation, and/or actions. The input can be mediated by a hardware controller that interprets the signals received from the input device and communicates the information to the processors 510 using a communication protocol. Processors 510 can be a single processing unit or multiple processing units in a device or distributed across multiple devices. Processors 510 can be coupled to other hardware devices, for example, with the use of a bus, such as a PCI bus or SCSI bus. The processors 510 can communicate with a hardware controller for devices, such as for a display 530. Display 530 can be used to display manufacturing steps, data, text, graphics, indicators, etc. In some implementations, display 530 provides graphical and/or textual visual feedback (e.g., beverage data, manufacturing data, dosage information, etc.) to a user. In some implementations, display 530 includes the input device as part of the display, such as when the input device is a touchscreen. Examples of display devices are: an LCD display screen, an LED display screen, a projected or augmented reality display, such as a heads-up display device or a head-mounted device, and so on. For example, an augmented reality display can display dosing information in a virtual environment (e.g., a virtual environment for mediation, therapy, etc.). Other I/O devices 540 can also be coupled to the processor, such as a user device (e.g., user device 510), network card, video card, audio card, USB, firewire or other external device, camera, speakers, etc. The communication device can communicate with another device or a server through a network using, for example, TCP/IP protocols. The system 500 can utilize the communication device to distribute operations across multiple network devices.

The processors 510 can have access to a memory 550 in a device or distributed across multiple devices. A memory includes one or more of various hardware devices for volatile and non-volatile storage, and can include both read-only and writable memory. For example, a memory can comprise random access memory (RAM), various caches, CPU registers, read-only memory (ROM), and writable non-volatile memory, such as flash memory, hard drives, floppy disks, CDs, DVDs, magnetic storage devices, tape drives, and so forth. A memory is not a propagating signal divorced from underlying hardware; a memory is thus non-transitory. Memory 550 can include program memory 560 that stores programs and software, such as an operating system 562, database 564, and other application programs 566. The database 564 can include, without limitation, liner databases, dosage databases, activation databases (e.g., activation database 350), beverage databases, active ingredient databases, user history databases, or the like. The application programs 566 can include, for example, container manufacturing programs, container usage programs, container filling programs, beverage filling programs, etc. Memory 550 can also include data memory 570, which can be provided to the program memory 560 or any element of the device.

The systems disclosed herein use one or more algorithms to interpret data (e.g., test results) from a dosing method (e.g., dosing method 460, which is described in greater detail regarding FIG. 4) and update one or more of parameters disclosed herein accordingly. The systems and devices disclosed herein can be configured for machine learning model(s) to, for example, interpret the data, determine dosages, etc. The machine learning models can be of various types, such as Convolutional Neural Networks (CNNs), other types of neural networks (e.g., fully connected), decision trees, forests of classification trees, Support Vector Machines, etc. Machine learning models can be trained to produce particular types of results, operations, etc. For example, a training procedure can include obtaining suitable training items with input associated with a result, applying each training item to the model, and updating model parameters based at least partially on a comparison of one or more model results to one or more training item results. In some embodiments, a beverage container can be designed to provide predetermined dosages. The dosages can be generated based on, for example, user data (e.g., historical data, empirically generated data, etc.), healthcare provider or physician input, or the like. The system can determine the volume of liquid, weight of active ingredient, etc. to be dispensed into the beverage container. The system can determine the characteristics of a liquid (e.g., water, tea, energy drink, alcoholic beverage, etc.) based on, for example, the time the beverage will be held in the container prior to consumption. For example, the system can determine a formulation of one or more active ingredients based on, for example, predicted consumption time, consumption period (e.g., 1 minute, 10 minutes, 1 hour, 2 hours, etc.), etc. Additionally, or alternatively, the system can determine an application type (e.g., the application type 352, which is described in greater detail regarding FIG. 3), one or more application parameters (e.g., one or more of the parameters 354, which are described in greater detail regarding FIG. 3), a formulation of an active ingredient coating (e.g., the coating 140, described in greater detail regarding FIGS. 1A and 1*i*), and/or any other suitable aspect of the active beverage containers of the present technology. To consume a beverage within 1 minute of mixing, the active ingredient can be formulated to be dissolved within a liquid within, for example, 10 seconds, 30 seconds, etc. A user can dispense liquid into a container and vigorously shake the container to rapidly produce an active ingredient beverage mixture. The user can then drink the mixture immediately to obtain an effective dosage.

C. Conclusion

The above detailed description of embodiments of the technology are not intended to be exhaustive or to limit the technology to the precise form disclosed above. Although specific embodiments of, and examples for, the technology are described above for illustrative purposes, various equivalent modifications are possible within the scope of the technology as those skilled in the relevant art will recognize. For example, any of the features of the beverage containers described herein may be combined with any of the features of the other beverage containers described herein and vice versa. Moreover, although steps are presented in a given order, alternative embodiments may perform steps in a different order and/or omit one or more of the steps. The various embodiments described herein may also be combined to provide further embodiments.

From the foregoing, it will be appreciated that specific embodiments of the technology have been described herein for purposes of illustration, but well-known structures and functions associated with beverage containers have not been shown or described in detail to avoid unnecessarily obscuring the description of the embodiments of the technology. Where the context permits, singular or plural terms may also include the plural or singular term, respectively.

Unless the context clearly requires otherwise, throughout the description and the examples, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. As used herein, the phrase "and/or" as in "A and/or B" refers to A alone, B alone, and A and B. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

What is claimed is:

1. A method of manufacturing an active ingredient beverage container, the method comprising:

positioning a first dose of an active ingredient within an interior of the active ingredient beverage container by applying a coating to at least a portion of the interior, wherein the coating includes the active ingredient;

filling the interior at least partially with a liquid;

positioning an active ingredient release component to release a second dose of the active ingredient into the interior;

causing the first dose of the active ingredient to mix with the liquid, wherein causing the first dose of the active ingredient to mix with the liquid is based at least partially on an activation parameter associated with the active ingredient; and causing at least part of the second dose of the active ingredient to mix with the liquid by moving the active ingredient release component to break a frangible element of the active ingredient release component and thereby release at least part of the second dose from the active ingredient release component into the interior to mix with the liquid.

2. The method of claim 1 wherein the activation parameter includes a duration of a physical agitation, the method further comprising:

applying the physical agitation for the duration to at least part of the active ingredient beverage container to cause mixing of the active ingredient and the liquid.

3. The method of claim 1 wherein positioning the active ingredient within the interior includes positioning at least one cannabinoid or at least one alkaloid within the interior.

4. The method of claim 1 wherein positioning the active ingredient within the interior of the active ingredient beverage container includes positioning a binder compound within the interior, wherein the binder compound is configured to releasably couple the active ingredient to the interior of the active ingredient beverage container.

5. The method of claim 4 wherein the binder compound includes one or more of polyethylene glycol, polyvinylpyrrolidone, polyvinyl alcohol, starch, glucose, cellulose ether, edible carnauba wax, guar gum, pectin, and/or xanthan gum.

6. The method of claim 1 wherein positioning the active ingredient in the interior includes coupling a liner to at least a portion of the interior of the active ingredient beverage container.

7. The method of claim 1, further comprising coupling a liner to a container wall of the active ingredient beverage container, and wherein, when the interior is at least partially filled with the liquid, the liner is positioned at least partially between the liquid and the container wall.

8. The method of claim 1 wherein the active ingredient release component is configured to release at least part of the second dose of the active ingredient upon meeting of the activation parameter.

9. The method of claim 8 wherein meeting the activation parameter includes moving at least part of the active ingredient release component relative to the interior of the active ingredient beverage container.

10. The method of claim 8, further comprising agitating the active ingredient release component so as to release at least part of the active ingredient contained within the active ingredient release component to mix the released active ingredient with the liquid.

11. The method of claim 1 wherein filling the interior at least partially with the liquid includes filling the interior at least partially with water.

12. The method of claim 1 wherein filling the interior at least partially with the liquid includes filling the interior at least partially with a carbonated liquid.

13. A method, comprising:

filling an interior of an active ingredient beverage container at least partially with a liquid; and configuring an active ingredient release component of the active ingredient beverage container such that at least part of the active ingredient release component is configured to rotate relative to the interior of the active ingredient beverage container to release at least part of an active ingredient, which is contained by the active ingredient beverage container, into the interior to cause the released active ingredient to mix with the liquid.

14. The method of claim 13 wherein the active ingredient includes at least one cannabinoid that, when released into the interior, mixes with the liquid.

15. The method of claim 13 wherein the active ingredient includes at least one alkaloid that, when released into the interior, mixes with the liquid.

16. The method of claim 13 wherein configuring the active ingredient release component includes configuring the active ingredient release component to break a frangible element when rotated to release at least part of the active ingredient into the interior.

17. The method of claim 13 wherein configuring the active ingredient release component includes configuring a lid for the active ingredient beverage container to release at least part of the active ingredient into the interior of the active ingredient beverage container.

18. The method of claim 17 wherein the lid includes a dispensing device configured to contain the active ingredient, and wherein configuring the lid includes configuring the dispensing device to release at least part of the active ingredient when the lid is rotated relative to the active ingredient beverage container.

19. A method of manufacturing an active ingredient beverage container, the method comprising:

providing an active ingredient beverage container defining an opening and an interior configured to receive an amount of liquid beverage via the opening;

applying a coating to at least a portion of the interior, wherein the coating includes a first dose of an active ingredient configured to mix with the liquid beverage during or after filling of the interior with the liquid beverage, wherein the mixing of the first dose of the active ingredient and the liquid beverage is based at least partially on an activation parameter associated with the active ingredient; and positioning an active ingredient release component to release a second dose of the active ingredient into the interior to mix with the liquid beverage, wherein the active ingredient release component includes a frangible element configured to retain the second dose within the active ingredient release component and release at least part of the second dose into the interior to mix with the liquid beverage in response to movement of the active ingredient release component that breaks the frangible element.

20. The method of claim 19 wherein the active ingredient includes at least one cannabinoid.

21. The method of claim 19 wherein the active ingredient includes at least one alkaloid.

22. The method of claim 19, further comprising:

applying a binder compound to at least the portion of the interior, wherein the binder compound is configured to releasably couple at least the active ingredient to the active ingredient beverage container when the coating is applied to at least the portion of the interior.

23. The method of claim 19 wherein the activation parameter includes a temperature.

24. The method of claim 19 wherein the activation parameter includes physical agitation.

25. The method of claim 19 wherein the activation parameter includes passive diffusion.

26. A method of manufacturing an active ingredient beverage container, the method comprising:

positioning an active ingredient within an interior of the active ingredient beverage container by applying a coating to at least a portion of the interior, wherein the coating includes the active ingredient;

filling the interior at least partially with a liquid; and causing the active ingredient to mix with the liquid, wherein causing the active ingredient to mix with the liquid is based at least partially on an activation parameter associated with the active ingredient, wherein the activation parameter includes a wavelength of an electromagnetic signal, and the method further comprises applying the electromagnetic signal having the wavelength to at least part of the active ingredient beverage container to cause mixing of the active ingredient and the liquid, or a magnitude of a magnetic force, and the method further comprises applying the magnetic force having the magnitude to at least part of the active ingredient beverage container to cause mixing of the active ingredient and the liquid.

27. A method of manufacturing an active ingredient beverage container, the method comprising:

positioning an active ingredient within an interior of the active ingredient beverage container by applying a coating including the active ingredient to impregnate a liner positioned within the interior with the active ingredient;

filling the interior at least partially with a liquid; and causing the active ingredient to mix with the liquid, wherein causing the active ingredient to mix with the liquid is based at least partially on an activation parameter associated with the active ingredient.

28. A method of manufacturing an active ingredient beverage container, the method comprising:

positioning a first dose of an active ingredient within an interior of the active ingredient beverage container by applying a coating to at least a portion of the interior;

filling the interior at least partially with a liquid; and positioning an active ingredient release component relative to the interior, wherein the active ingredient release component includes a lid for the active ingredient beverage container and is configured to releasably contain a second dose of the active ingredient, and wherein positioning the active ingredient release component includes coupling the lid to the active ingredient beverage container to cover at least a portion of an opening to the interior; or sealing the interior with the lid.

* * * * *